United States Patent [19]

Brown

[11] Patent Number: 4,678,548

[45] Date of Patent: Jul. 7, 1987

[54] CORROSION-RESISTANT SUPPORT APPARATUS AND METHOD OF USE FOR INERT ELECTRODES

[75] Inventor: Melvin H. Brown, Allegheny Township, Allegheny County, Pa.

[73] Assignee: Aluminum Company of America, Pittsburgh, Pa.

[21] Appl. No.: 887,637

[22] Filed: Jul. 21, 1986

[51] Int. Cl.[4] ..... C25C 3/10

[52] U.S. Cl. ..... 204/67; 204/286; 204/247 R

[58] Field of Search ..... 204/286, 67, 297 R

[56] References Cited

U.S. PATENT DOCUMENTS

| | | | |
|---|---|---|---|
| 2,079,144 | 5/1937 | Appa | 257/262 |
| 2,247,199 | 6/1941 | Kritzer | 29/157.3 |
| 2,254,587 | 9/1941 | Williams | 62/1 |
| 2,310,970 | 2/1943 | Limpert | 257/262 |
| 2,453,448 | 11/1948 | McTurk | 257/262.20 |
| 2,553,142 | 5/1951 | McCreary | 29/157.33 |
| 3,195,627 | 7/1965 | Goodloe | 165/181 |
| 3,468,345 | 9/1969 | Tam et al. | 138/38 |
| 3,554,893 | 1/1971 | DeVarda | 204/244 |
| 3,636,982 | 1/1972 | Drake | 138/38 |
| 3,745,106 | 7/1973 | Jacobs | 204/243 R |
| 3,755,099 | 8/1973 | Haupin | 204/64 R |
| 3,772,201 | 11/1973 | Mills | 204/277 |
| 3,783,938 | 1/1974 | Chartet | 165/166 |
| 3,784,371 | 1/1974 | Bangs et al. | 75/68 R |
| 3,785,941 | 1/1974 | Jacobs | 204/67 |
| 3,800,182 | 3/1974 | Wilczek | 315/3.5 |
| 3,825,063 | 7/1974 | Cowans | 165/146 |
| 3,825,064 | 7/1974 | Inoue | 165/179 |
| 3,847,212 | 11/1974 | Withers et al. | 165/179 |
| 3,859,040 | 1/1975 | Shefsiek et al. | 432/214 |
| 3,870,081 | 3/1975 | Kleppe et al. | 138/38 |
| 3,884,792 | 5/1975 | McGilvery | 204/290 F |
| 3,886,976 | 6/1975 | Kardas et al. | 138/38 |
| 3,895,675 | 7/1975 | Rein et al. | 165/164 |
| 3,960,678 | 6/1976 | Alder | 204/67 |
| 3,974,046 | 8/1976 | Alder | 204/67 |
| 3,996,117 | 12/1976 | Graham et al. | 204/67 |
| 4,049,511 | 9/1977 | Alder et al. | 204/67 |
| 4,090,559 | 5/1978 | Megerlin | 165/179 |
| 4,098,651 | 7/1978 | Alder | 204/1 T |
| 4,110,178 | 8/1978 | LaCamera et al. | 204/64 R |
| 4,113,009 | 9/1978 | Meyer et al. | 165/154 |
| 4,116,270 | 9/1978 | Marushkin et al. | 165/162 |
| 4,119,519 | 10/1978 | Clapper | 204/268 |
| 4,121,983 | 10/1978 | Kinosz et al. | 204/67 |
| 4,147,210 | 4/1979 | Pronko et al. | 165/165 |
| 4,170,533 | 10/1979 | Alder et al. | 204/243 R |
| 4,197,169 | 4/1980 | Zahn et al. | 204/1 R |
| 4,197,178 | 4/1980 | Pellegri et al. | 204/255 |
| 4,243,502 | 1/1981 | Kugler | 204/243 R |
| 4,257,855 | 3/1981 | Zaromb | 204/67 |
| 4,265,275 | 5/1981 | Heller et al. | 138/38 |
| 4,279,731 | 7/1981 | Pellegri | 204/254 |
| 4,288,309 | 9/1981 | Cohen | 204/225 |
| 4,296,779 | 10/1981 | Smick | 138/38 |
| 4,306,619 | 12/1981 | Trojani | 165/179 |
| 4,333,803 | 6/1982 | Seger et al. | 204/67 |
| 4,341,262 | 7/1982 | Alspaugh | 165/1 |
| 4,352,378 | 10/1982 | Bergmann et al. | 138/38 |

FOREIGN PATENT DOCUMENTS

| | | |
|---|---|---|
| 3100921 | 8/1982 | Fed. Rep. of Germany . |
| 1462332 | 1/1977 | United Kingdom . |

OTHER PUBLICATIONS

*Machine Design*, Feb. 25, 1982, p. 44.

*Primary Examiner*—John F. Niebling
*Assistant Examiner*—Terryence Chapman
*Attorney, Agent, or Firm*—Douglas G. Glantz

[57] ABSTRACT

This invention includes apparatus and method for providing a support mechanism for electrode assemblies including positioning means of electrically nonconductive material having an inside surface forming an internal cavity, means for passing a heat transfer fluid through the cavity along the inside surface, and wire or fiber in the path of the fluid. The wire or fiber is positioned essentially normal to the flow of the fluid and is positioned to provide a substantially unobstructed line of sight between the wire or fiber and the inside surface, the wire or fiber having a high radiative absorptance and emittance.

9 Claims, 1 Drawing Figure

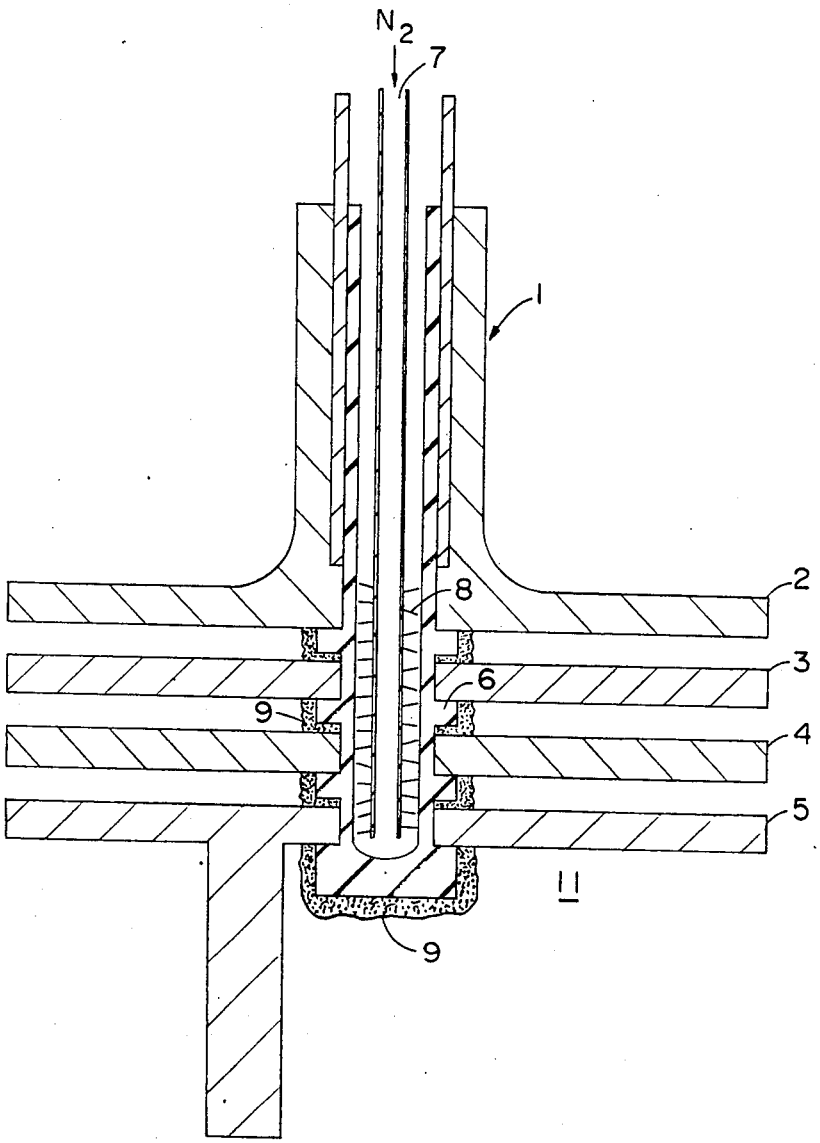
N2
7
1
2
8
3
6
9
4
5
11
9

CORROSION-RESISTANT SUPPORT APPARATUS AND METHOD OF USE FOR INERT ELECTRODES

BACKGROUND OF THE INVENTION

1. Technical Field

The present invention relates to apparatus and method for supporting and positioning inert electrodes in electrolytic reduction cells for the production of aluminum.

2. Description of Conventional Art

The electrolytic reduction smelting of aluminum involves an electrochemical oxidation-reduction reaction associated with the decomposition of alumina dissolved in cryolite electrolyte bath. The electrolyte bath in such a process is a fluoride-ion-containing molten salt solution which is very corrosive.

The production cells for the electrolytic smelting of aluminum according to the Hall-Heroult process have been the subject of novel electrode designs recently. For example, U.S. patent application Ser. No. 488,783, filed Apr. 26, 1983 and still pending, by Noel Jarrett involves a novel electrolytic cell and method of electrolysis using supported electrodes. The Jarrett patent application addresses a significant problem which develops in standard commercial practice for producing aluminum, which is exemplified in fluoride-containing electrolyte bath electrolysis as in the Hall-Heroult process, when the electrode is supported by the floor or wall of the electrolytic cell. This problem derives from a warping of the internal surfaces of the cell, e.g., the floor or the wall, which occurs during the operation of the aluminum-producing cell under the normally harsh operating conditions of electrolytic smelting of alumina dissolved in cryolite electrolyte bath. Such warping will destroy a specified and particular electrode placement or positioning when the electrodes are fixed to or supported by the wall or floor of the cell. The Jarrett patent application provides a remedy for these problems by achieving and operating an electrolytic cell having a specified anode-cathode distance which can be maintained very small over a longer period of time than previously possible. In fact, the Jarrett invention provides an ability to establish an inter-electrode zone having a specified dimension which is essentially fixed.

However, there is a need for providing a spacer between the anode and cathode in a monopolar electrode assembly or between adjacent bipolar electrode surfaces in a bipolar electrode assembly in an electrolytic cell adapted to employ a specified anode-cathode distance.

It is an object of the present invention to provide a corrosion-resistant positioning means for electrodes immersed in a corrosive chemical bath, e.g., such as a fluoride-containing electrolyte bath in an aluminum smelting electrolysis cell.

It is a further object of the present invention to provide a spacer for positioning adjacent anode surfaces and cathode assemblies in monopolar and bipolar electrode assemblies to provide a specified anode-cathode distance and which will not be destroyed by the combinations of molten aluminum and fluoride-containing molten metal bath at the cathode and oxygen and fluoride-containing bath at the anode.

These and other objects of the present invention will become evident from the detailed description which follows.

SUMMARY OF THE INVENTION

The present invention involves apparatus and method for providing a support mechanism for electrode assemblies including positioning means of electrically nonconductive material having an inside surface forming an internal cavity, means for passing a heat transfer fluid through the cavity along the inside surface, and wire or fiber in the path of the fluid. The wire or fiber is positioned essentially normal to the flow of the fluid and is positioned to provide a substantially unobstructed line of sight between the wire or fiber and the inside surface, the wire or fiber having a high radiative absorptance and emittance.

The method of the present invention includes protecting an electrode positioning member from corrosive attack while immersed in a chemical bath, the positioning member being composed of an electrically nonconductive material and having an inside surface forming an internal cavity, which includes, passing clear coolant through the cavity along the inside surface, and establishing wire or fiber in the cavity positioned normal to the path of the coolant and further positioned to provide a direct line of sight between the wire or fiber and the inside surface, the wire having a radiative absorptance and emittance of at least 0.5.

THE DRAWINGS

The sole FIGURE shows a schematic diagram of the corrosion-resistant support and spacer mechanism of the present invention.

DETAILED DESCRIPTION

A noncorrosive and electrically nonconductive support and positioning means is provided for positioning inert anode and inert cathode assemblies to form a specified anode-cathode distance in the electrolysis of alumina dissolved in cryolite electrolyte bath as used in the Hall-Heroult process. The support and positioning means of the present invention overcomes problems associated with the corrosive combinations of molten aluminum and fluoride-containing molten metal electrolyte bath at the cathode and oxygen and the electrolyte bath at the anode.

An inert electrically nonconductive material is essential for spacers in inert anode-inert cathode assemblies for electrolyzing alumina dissolved in Hall bath. Finding a spacer material that will not be attacked by the combinations of molten aluminum and Hall bath at the cathode and oxygen in the Hall bath at the anode may be difficult or even impossible. However, a solution to the problem is provided by the apparatus and process of the present invention. A spacer having a hollow cavity through which a coolant, such as nitrogen gas, could be passed to freeze the protective layer of bath around the spacer, is provided, the heat transfer area inside the spacer being packed with a fine wire or fiber having high absorptive surface, to facilitate heat transfer by radiation. A layer of frozen bath forming around the spacer protects the inert anode-inert cathode assembly from attack by the corrosive fluoride-containing molten metal bath of the typical Hall-Heroult electrolytic smelting cell for producing aluminum.

Referring now to the FIGURE, a bipolar electrode assembly 1 having terminal anode 2, bipolar electrodes 3 and 4, and terminal cathode 5 is shown in schematic elevation. Positioning means 6 is disposed to provide a spacing function between the anodic surface and the cathodic surface of each of the aforementioned electrodes. The positioning means 6 has a hollow cavity 7 through which a coolant such as nitrogen gas can be passed. Wire-like appendages in the cavity 7 denoted as appendage elements 8 are disposed to enhance the heat transfer effects as disclosed in my related co-pending patent application Ser. No. 876,113, filed June 19, 1986, and still pending which is hereby incorporated by reference in its entirety. The cooling effect of coolant flowing through the hollow cavity has the effect of forming a frozen bath 9 around the spacing appendage 6 of overall positioning means of the present invention, i.e., including the cooling means of hollow cavity 7.

In one aspect, the invention also involves using a plurality of wire appendages in the hollow for positioning means to enhance the heat transfer of the coolant gas flowing through the hollow cavity out to the bath and provide a frozen bath around the spacer positioning means of the present invention.

In another aspect, the invention involves a regulating function for maintaining the thickness of frozen bath 9 around spacer 6. The thickness of the frozen layer 9 increases as the heat transferred from molten bath 11 increases, and the thickness of the frozen layer 9 decreases as the heat transferred from the molten bath 11 decreases. Thus, the thickness of the frozen layer 9 can be regulated by controlling the heat removed from the molten bath 11.

Other coolants can be water or steam: the inert gases, e.g., such as helium or argon; hydrogen, which provides high heat transfer but must be monitored closely to prevent leaks, or commercial clear fluids such as Dowtherm diphenyl or other high boiling point liquids.

While the invention has been described in terms of preferred embodiments, the claims appended hereto are intended to encompass all embodiments which fall within the spirit of the invention.

What is claimed is:

1. Corrosion-resistant positioning means for electrodes immersed in a chemical bath comprising:
   (a) positioning means of electrically nonconductive material having an inside surface forming an internal cavity;
   (b) means for passing a heat transfer fluid through said cavity along said inside surface; and
   (c) wire in the path of said fluid positioned normal to the flow of said fluid and positioned to provide a substantially unobstructed line of sight between said wire and said inside surface, said wire having a high radiative absorptance and emittance.

2. Positioning means as set forth in claim 1, said heat transfer fluid being substantially clear.

3. Positioning means as set forth in claim 2 wherein said means for passing comprises means for cooling said inside surface.

4. Positioning means as set forth in claim 3, wherein said fluid comprises a gas.

5. Positioning means as set forth in claim 4 wherein said cooling means is capable of providing a protective layer of frozen bath on the outside surface of said positioning means.

6. Positioning means as set forth in claim 5 wherein said chemical bath contains cryolite.

7. Positioning means as set forth in claim 6 wherein said gas comprises nitrogen.

8. A method for protecting an electrode positioning member from corrosive attack while immersed in a chemical bath, said positioning member being composed of an electrically nonconductive material and having an inside surface forming an internal cavity, comprising:
   (a) passing a clear coolant through said cavity along said inside surface; and
   (b) establishing wire in said cavity positioned normal to the path of said coolant and further positioned to provide a direct line of sight between said wire and said inside surface, said wire having a radiative absorptance and emittance of at least about 0.5.

9. A method as set forth in claim 6 wherein said coolant comprises nitrogen.

* * * * *